US012404694B2

(12) United States Patent
Graybill

(10) Patent No.: US 12,404,694 B2
(45) Date of Patent: Sep. 2, 2025

(54) LOAD PATH REDISTRIBUTION FIELD COUPLER

(71) Applicant: Crow Hill LLC, Mount Pleasant, SC (US)

(72) Inventor: Robert Steven Graybill, Mount Pleasant, SC (US)

(73) Assignee: Crow Hill LLC, Mount Pleasant, SC (US)

( * ) Notice: Subject to any disclaimer, the term of this patent is extended or adjusted under 35 U.S.C. 154(b) by 31 days.

(21) Appl. No.: 18/320,840

(22) Filed: May 19, 2023

(65) Prior Publication Data

US 2023/0407670 A1 Dec. 21, 2023

Related U.S. Application Data

(60) Provisional application No. 63/365,082, filed on May 20, 2022.

(51) Int. Cl.
*E04H 15/30* (2006.01)
*A45B 5/00* (2006.01)
(Continued)

(52) U.S. Cl.
CPC ..... *E04H 15/30* (2013.01); *A47C 4/28* (2013.01); *E04H 15/26* (2013.01); *E04H 15/32* (2013.01);
(Continued)

(58) Field of Classification Search
CPC ..... E04H 15/30; E04H 15/26; E04H 15/32; E04H 15/34; E04H 15/44; E04H 15/48; E04H 2015/328; A45B 5/00
(Continued)

(56) References Cited

U.S. PATENT DOCUMENTS 1,653,822 A * 12/1927 Pliskin ..... E04H 15/48 135/905
2,362,567 A * 11/1944 La Rue ..... A47B 3/12 135/96
(Continued)

FOREIGN PATENT DOCUMENTS

CN 110248571 A 9/2019
EP 0 230 680 * 5/1987 ..... A47C 1/14
(Continued)

*Primary Examiner* — Robert Canfield
(74) *Attorney, Agent, or Firm* — Thompson Patent Law Offices PC

(57) ABSTRACT

Apparatus and associated methods relate to distributing a laterally distributed load applied by a flexible surface to one or more longitudinal load paths. A support connection hub may, for example, include a first cavity extending longitudinally along a first axis and configured to receive a vertical support member at a bottom side of the support connection hub. The hub may, for example, include a second cavity extending across a top of the hub along a second axis orthogonal to the first axis. The second cavity may, for example, be horizontally and releasably receive a lateral support member orthogonal to the vertical support member such that the lateral rod is configured to support a flexible surface distributed along the lateral rod. Various embodiments may advantageously transfer a load from the flexible surface to the vertical rod along a load path substantially parallel to the first longitudinal axis.

8 Claims, 6 Drawing Sheets

(51) Int. Cl.

| | |
|---|---|
| ***A47C 4/28*** | (2006.01) |
| ***E04H 15/26*** | (2006.01) |
| ***E04H 15/32*** | (2006.01) |
| ***E04H 15/34*** | (2006.01) |
| ***E04H 15/44*** | (2006.01) |
| ***E04H 15/48*** | (2006.01) |

(52) U.S. Cl.
CPC ..... *E04H 15/34* (2013.01); *E04H 15/44* (2013.01); *E04H 15/48* (2013.01); *E04H 2015/328* (2013.01)

(58) Field of Classification Search
USPC ..... 135/114, 120.3, 909; 446/120, 126
See application file for complete search history.

(56) References Cited

U.S. PATENT DOCUMENTS

| | | | | |
|---|---|---|---|---|
| 2,790,452 | A * | 4/1957 | Dusek | E04H 15/04 135/96 |
| 3,272,540 | A * | 9/1966 | Glanzer | E04G 7/14 52/651.1 |
| 3,360,883 | A * | 1/1968 | Glanzer | F16B 7/0493 24/339 |
| 3,383,127 | A * | 5/1968 | Grunfeld | F16B 7/00 135/96 |
| 3,424,178 | A * | 1/1969 | Yoshimi | E04B 1/34326 135/160 |
| 3,730,544 | A * | 5/1973 | Hyman | A63C 11/22 135/65 |
| 4,352,255 | A * | 10/1982 | Warehime | F16B 7/0493 446/124 |
| 4,484,832 | A * | 11/1984 | Weissenberger | F16B 7/0486 280/281.1 |
| 4,610,122 | A * | 9/1986 | De Clercq | E04C 5/167 24/339 |
| D304,904 | S * | 12/1989 | Kercher | D8/382 |
| D355,582 | S * | 2/1995 | Sleight | D8/380 |
| 5,697,591 | A * | 12/1997 | Cooper | F21V 21/08 362/396 |
| 6,289,834 | B1 * | 9/2001 | Phillips | B63J 2/04 454/82 |
| 6,896,437 | B2 * | 5/2005 | Morgan | F16B 7/0446 135/909 |
| 7,059,307 | B2 | 6/2006 | Pellizzari et al. | |
| 7,406,977 | B1 * | 8/2008 | Shires | E04H 15/26 135/121 |
| 8,701,688 | B2 | 4/2014 | Vaughn et al. | |
| 9,051,756 | B1 * | 6/2015 | Jenkins | E04H 15/58 |
| 9,255,396 | B2 * | 2/2016 | Eberhart | F16B 7/0486 |
| 9,854,882 | B1 * | 1/2018 | Peck | A45B 3/00 |
| 9,903,134 | B2 * | 2/2018 | Munnerlyn | E04H 15/001 |
| 10,285,503 | B2 | 5/2019 | Graybill | |
| 10,531,740 | B2 | 1/2020 | Graybill | |
| 11,166,530 | B1 * | 11/2021 | Wilson, Jr. | A45B 5/00 |
| 11,215,209 | B2 * | 1/2022 | Ramey | A01G 9/247 |
| 11,369,202 | B2 | 6/2022 | Graybill | |
| 11,459,781 | B2 * | 10/2022 | Huang | F16B 7/0406 |
| D971,780 | S * | 12/2022 | Tao | D11/181 |
| 11,672,350 | B2 | 6/2023 | Graybill | |
| 11,686,120 | B1 * | 6/2023 | Yates | E04H 15/44 135/143 |
| 11,700,922 | B2 * | 7/2023 | Davis | A45B 5/00 297/16.1 |
| RE50,266 | E | 1/2025 | Graybill | |
| 2011/0156466 | A1 * | 6/2011 | Linn | A47C 1/146 297/452.18 |
| 2011/0203628 | A1 * | 8/2011 | Gross | E04H 15/34 135/96 |
| 2012/0291830 | A1 * | 11/2012 | Crimi | E04H 15/58 135/117 |
| 2014/0041703 | A1 * | 2/2014 | Funston | E04H 15/54 135/121 |
| 2016/0022042 | A1 * | 1/2016 | Homans | A47C 4/03 297/16.1 |
| 2018/0235368 | A1 * | 8/2018 | Graybill | A47C 4/02 |
| 2020/0165835 | A1 * | 5/2020 | Shires | E04H 15/62 |
| 2021/0052076 | A1 * | 2/2021 | Graybill | A47C 4/286 |
| 2021/0386204 | A1 * | 12/2021 | Hu | A47C 4/283 |
| 2023/0235592 | A1 * | 7/2023 | Michel | E04H 15/28 135/115 |

FOREIGN PATENT DOCUMENTS

| | | | |
|---|---|---|---|
| EP | 3576572 | A1 | 12/2019 |
| JP | 2020506031 | A | 2/2020 |
| KR | 1020190115039 | A | 10/2019 |
| WO | 2018145039 | A1 | 8/2018 |

* cited by examiner

LOAD PATH REDISTRIBUTION FIELD COUPLER

CROSS-REFERENCE TO RELATED APPLICATIONS

This application claims the benefit of U.S. Provisional Application Ser. No. U.S. 63/365,082, titled "Systems and Accessories for Ultralight Trekking," filed by Robert Steven Graybill on May 20, 2022.

This application incorporates the entire contents of the foregoing application(s) herein by reference.

The subject matter of this application may have common inventorship with and/or may be related to the subject matter of the following:

- U.S. application Ser. No. 16/368,391, titled "Collapsible Chair," filed by Robert Steven Graybill on Mar. 28, 2019, and issued as U.S. Pat. No. 10,531,740 on Jan. 14, 2020;
- U.S. application Ser. No. 18/191,956, titled "ADAPTIVE CHAIR WITH MULTI-FUNCTIONAL BAG," filed by Robert Steven Graybill on Mar. 29, 2023;
- U.S. application Ser. No. 16/703,330, titled "Collapsible Chair," filed by Robert Steven Graybill on Dec. 4, 2019;
- U.S. application Ser. No. 17/187,610, titled "MULTI-PURPOSE ACCESSORY BAG FOR MULTI-MODE PORTABLE COLLAPSIBLE CHAIR," filed by Robert Steven Graybill on Feb. 26, 2021;
- Republic of Korea Application Serial No. 2019-7025750, titled "Collapsible Chair," filed by Robert Steven Graybill on Sep. 2, 2019;
- People's Republic of China Application Serial No. 2018800098805, titled "Collapsible Chair," filed by Robert Steven Graybill on Aug. 2, 2019;
- European Patent Office Application Serial No. 18748634.5, titled "Collapsible Chair," filed by Robert Steven Graybill on Sep. 2, 2019;
- Hong Kong Application Serial No. 62020001544.9, titled "Collapsible Chair," filed by Robert Steven Graybill on Jan. 16, 2020;
- Japan Application Serial No. 2019-563333, titled "Collapsible Chair," filed by Robert Steven Graybill on Aug. 2, 2019, and issued as U.S. Pat. No. 7,059,307 on Apr. 15, 2022;
- U.S. application Ser. No. 15/888,994, titled "Collapsible Chair," filed by Robert Steven Graybill on Feb. 5, 2018, and issued as U.S. Pat. No. 10,285,503 on May 14, 2019;
- U.S. application Ser. No. 16/892,205, titled "MULTI-MODE PORTABLE COLLAPSIBLE CHAIR WITH MULTIPURPOSE ACCESSORY BAG," filed by Robert Steven Graybill on Jun. 3, 2020, and issued as U.S. Pat. No. 11,369,202 on Jun. 28, 2022;
- PCT Application Serial No. PCT/US2018/016923, titled "Collapsible Chair," filed by Robert Steven Graybill on Feb. 5, 2018;
- U.S. Application Ser. No. 63/365,082, titled "SYSTEMS AND ACCESSORIES FOR ULTRALIGHT TREKKING," filed by Robert Steven Graybill on May 20, 2022;
- U.S. Application Ser. No. 62/454,112, titled "PORTABLE COLLAPSIBLE TREKKING POLE CHAIR," filed by Robert Steven Graybill on Feb. 3, 2017;
- U.S. Application Ser. No. 62/535,709, titled "Collapsible Alpine Chair," filed by Robert Steven Graybill on Jul. 21, 2017;

- U.S. Application Ser. No. 62/620,305, titled "MUHL AND CAPRA CHAIRS," filed by Robert Steven Graybill on Jan. 22, 2018;
- U.S. Application Ser. No. 62/890,941, titled "Crossover Chair, Bivvy/Tent, and Assorted Outdoor Gear," filed by Robert Steven Graybill on Aug. 23, 2019;
- U.S. application Ser. No. 17/576,476, titled "Collapsible Chair," filed by Robert Steven Graybill on Jan. 14, 2022;

This application incorporates the entire contents of the foregoing application(s) herein by reference.

TECHNICAL FIELD

Various embodiments relate generally to portable outdoor equipment.

BACKGROUND

Chairs are pieces of furniture in which people may sit. A chair may include legs, a seat, and a back. The number of legs on a chair may be three, four, or more legs. A seat of a chair may be cushioned or non-cushioned. The back of a chair may be inclined or may form a 90-degree angle with respect to a horizontal chair seat. There are different varieties of chairs. For example, a chair with arms may be referred to as an armchair. A chair with upholstery, reclining action, and a fold-out footrest may be referred to as a recliner. A permanently fixed chair in an airplane may be referred to as an airline seat. A chair used in an automobile may be referred to as a car seat. A chair with wheels may be referred to as a wheelchair.

Tents are outdoor coverings which may be used for people to shelter under. A tent may, for example, include an upper cover. The upper cover may, for example, protect from rain, wind, sun, thermal convection, thermal radiation, and/or thermal conduction. A tent may, for example, include a floor. The floor may, for example, protect from direct contact with the ground. A tent may, for example, include tension members (e.g., guide wires). The tension members may, for example, extend to stakes driven into the ground to help support and/or secure the tent in a desired location.

Outdoor activities are a pastime for many people who enjoy being active and present out in nature. Some people may spend at least a portion of their leisure time hiking in the woods, lounging on a beach, boating on a lake, or playing at a park, for example. When people participate in recreational activities like the ones described above, they often like to bring various utilitarian devices and leisure-facilitating consumer goods that may increase and/or augment the enjoyment of these recreational activities. For example, some people bring floats or paddle boards to a beach or a river for recreational enjoyment. Some people may receive significant satisfaction from carrying ice chests filled with cool drinks to an outdoor concert. Yet other people may spend their leisure time camping in the woods using an array of utilitarian items and survival gear.

SUMMARY

Apparatus and associated methods relate to distributing a laterally distributed load applied by a flexible surface to one or more longitudinal load paths. A support connection hub may, for example, include a first cavity extending longitudinally along a first axis and configured to receive a vertical support member at a bottom side of the support connection hub. The hub may, for example, include a second cavity extending across a top of the hub along a second axis orthogonal to the first axis. The second cavity may, for example, be horizontally and releasably receive a lateral support member orthogonal to the vertical support member such that the lateral rod is configured to support a flexible surface distributed along the lateral rod. Various embodiments may advantageously transfer a load from the flexible surface to the vertical rod along a load path substantially parallel to the first longitudinal axis.

Various embodiments may achieve one or more advantages. For example, some embodiments may advantageously provide a chair support frame. Some embodiments may, for example, advantageously provide a tent support frame. In some embodiments, frame members may, for example, be interchangeably used between a tent and a chair. For example, some embodiments may advantageously reduce the weight of frame members required to carry in ultralight trekking. As an illustrative example, some embodiments may allow a trekking pole to be used to support a chair and/or a tent. By way of example and not limitation, some embodiments may advantageously permit more functions to be available to ultralight trekkers such as, for example, by providing one or more multi-purpose structures configured to permit additional uses for the same components.

The details of various embodiments are set forth in the accompanying drawings and the description below. Other features and advantages will be apparent from the description and drawings, and from the claims.

Appendix A depicts exemplary embodiments of various systems and accessories which may be used, for example, in ultralight trekking.

Figure 3:
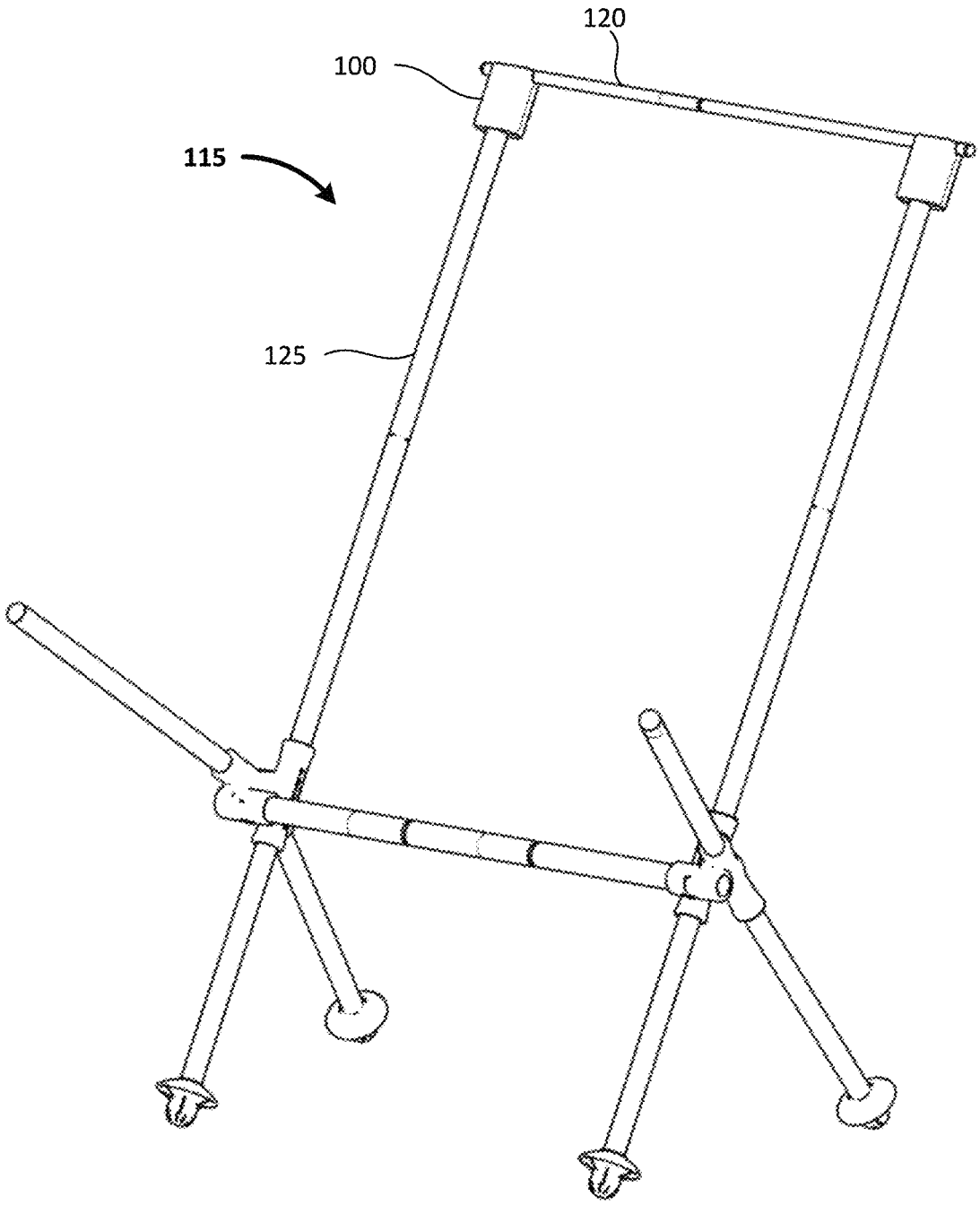
FIG. 3 depicts the hub in an illustrative use case supporting a collapsible chair.

Appendix B depicts an exemplary sequence of operations for configuring a chair, such as disclosed at least with reference to FIG. 3.

Appendix A and B are incorporated herein in their entirety, and form a portion of this disclosure.

Like reference symbols in the various drawings indicate like elements.

DETAILED DESCRIPTION OF ILLUSTRATIVE EMBODIMENTS

Figure 1:
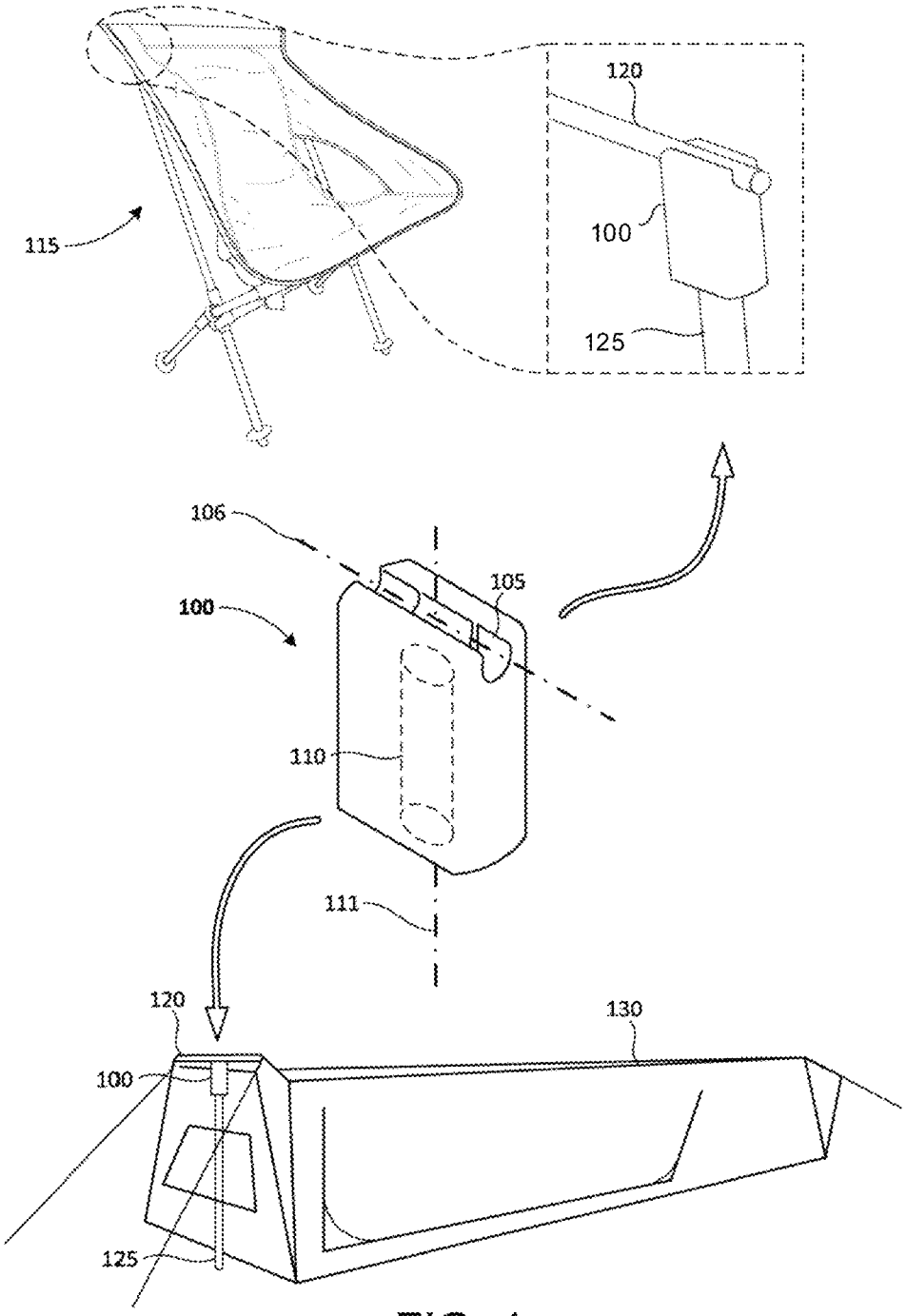
FIG. 1 depicts an exemplary support connection hub employed in an illustrative use-case scenario.

FIG. 1 depicts an exemplary support connection hub employed in an illustrative use-case scenario. In the depicted example, a support connection hub 100. The hub 100 includes a transverse cavity 105 extending along a first axis 106. The support connection hub 100 includes a longitudinal cavity 110 extending along a second axis 111. As depicted, the transverse cavity 105 and the longitudinal cavity 110 are aligned such that the first axis 106 and the second axis 111 intersect.

In the depicted example, the hub is depicted as being deployed in a 'seating' or 'chair' mode to provide support for a chair 115. A lateral frame member 120 is disposed in the transverse cavity 105. A vertical frame member 125 is disposed in the longitudinal cavity 110. A second support connection hub 100 may be disposed in the other side of the chair 115. Accordingly, the lateral frame member 120 and the vertical frame member 125 may be constrained by the support connection hub 100 to cooperate, for example, as part of a collapsible frame for the chair 115.

For example, the lateral frame member 120 and/or the vertical frame member 125 may, in some implementations, be portions of a walking pole (e.g., trekking pole, ski pole). Accordingly, for example, a weight of the chair 115 required to be carried may be effectively reduced by reducing the amount of dedicated frame required to support the chair. For example, the reduced weight may advantageously enable an ultralight trekker to carry a chair when they normally might not be able to. For example, an ultralight trekker may count weight by ounces due to extended trekking in rough terrain with no external access to food and water. The trekker may have a weight limit counted in ounces. The weight limit may be dominated by food and/or water. The weight limit may, for example, not admit of a chair unless the weight is reduced (e.g., negligible).

In the depicted example, the hub is also depicted as being deployed in a 'tent' mode to support a tent 130. For example, the lateral frame member 120 and the vertical frame member 125 are constrained by the support connection hub 100 to cooperate as, for example, a frame of the tent 130. For example, fabric of the tent may be distributed across the lateral frame member 120. The support connection hub 100 may cause the distributed load to be transferred to the ground via a load path provided by the vertical frame member 125. The support connection hub 100 may, for example, advantageously enable the tent to reduce or eliminate dedicated framing.

In some implementations, for example, the tent may be solely supported by tension members (e.g., guidewires) and the support connection hub 100, the lateral frame member 120, and the vertical frame member 125. For example, the lateral frame member 120 and/or the vertical frame member 125 may include (e.g., be) one or more portions of a walking pole. The lateral frame member 120 and/or the vertical frame member 125 may, for example, be one or more portions of a frame of the chair 115. For example, the support connection hub 100 may advantageously permit the tent 130, in some examples, to require no dedicated framing members.

Figure 2:
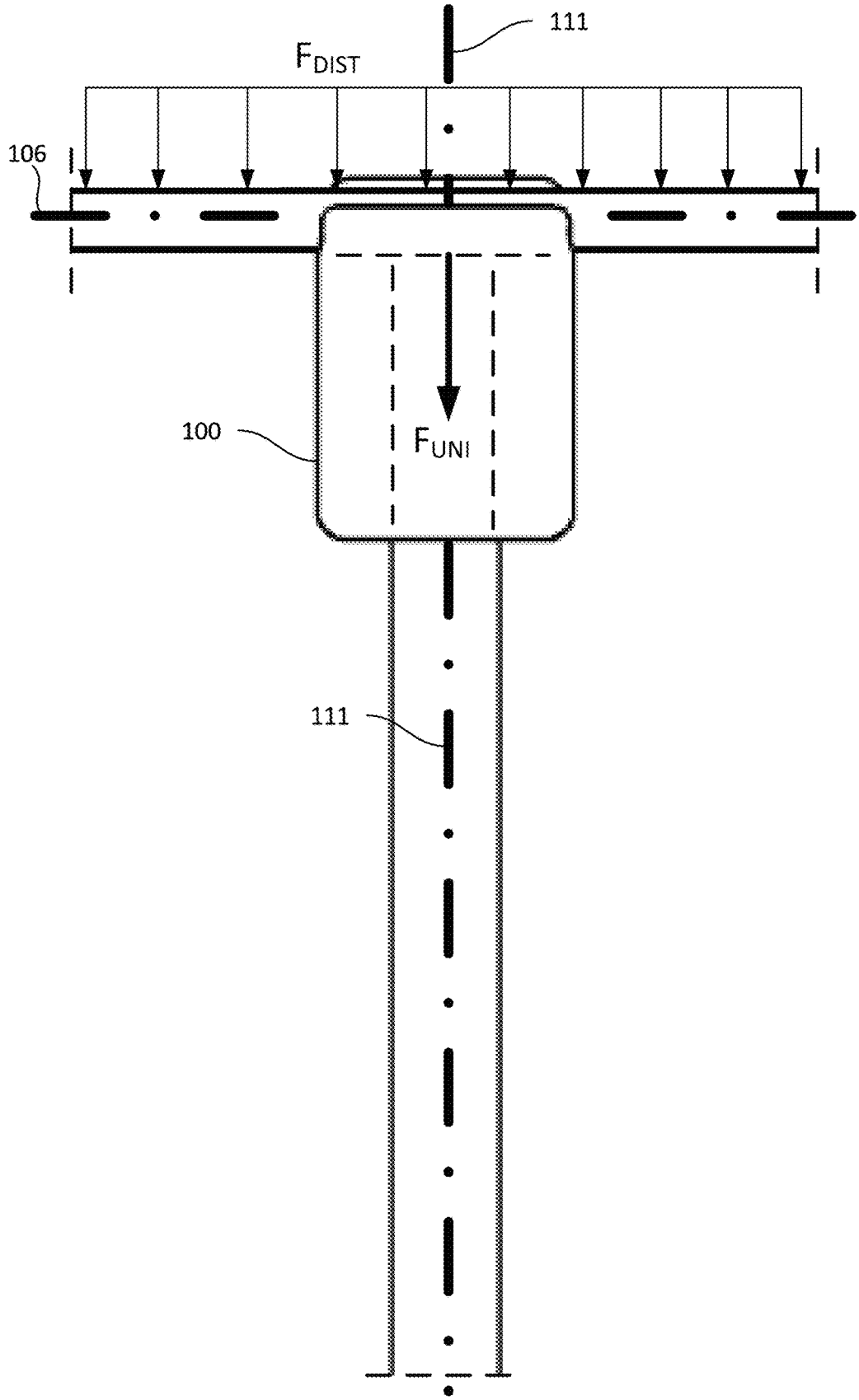
FIG. 2 is an illustrative force diagram of the support connection hub.

FIG. 2 is an illustrative force diagram of the support connection hub. A force (F_DIST) is distributed along the first axis 106. For example, the F_DIST may be applied by a flexible surface (e.g., a fabric chair seat, tent fabric) along the vertical frame member 125. The support connection hub 100 retains the lateral frame member 120 and vertical frame member 125 in opposing relationship such that the F_DIST is transferred from the lateral frame member 120 to the vertical frame member 125 as a unified force (F_UNI). Accordingly, the F_UNI may be transferred along one or more unified load paths (e.g., second axis 111, as depicted). For example, the vertical frame member 125 may transfer the F_UNI to the ground.

FIG. 3 depicts the hub in an illustrative use case supporting a collapsible chair.

Figure 4:
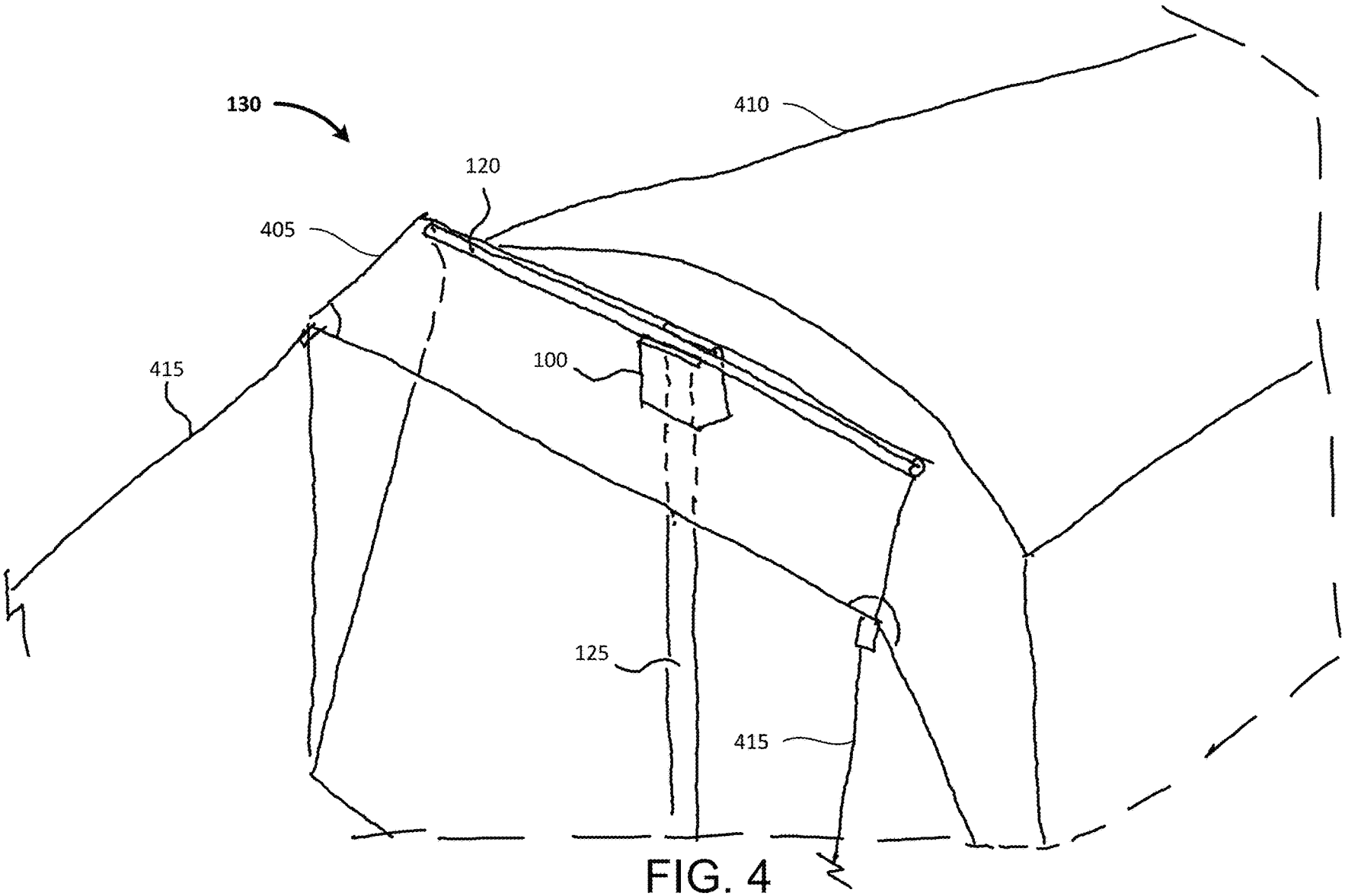
FIG. 4 depicts the hub in an illustrative use case supporting a collapsible tent.

FIG. 4 depicts the hub in an illustrative use case supporting a collapsible tent. In the depicted example, the tent 130 includes a tent body 410 (e.g., an upper cover). The tent 130 includes tension members 415 (e.g., guide wires coupled to stakes). In some implementations, the tent 130 may, for example, include additional tension members at an opposite end, such that opposing forces are applied to the lateral frame member 120 by the tension members 415 shown and by tension members applying tension along the longitudinal direction of the tent body 410.

The tension members 415 may apply tension, for example, to a vestibule 405. The vestibule 405 may, for example, advantageously provide a compartment fore of the tent (e.g., for stowage of goods).

The tension members 415, the vestibule 405, and/or the tent body 410 may operate as tension members to apply tension transvers to the lateral frame member 120 and/or downward. For example, the vestibule 405, the tension members 415, and/or the tent body 410 may generate a F_DIST applied to the lateral frame member 120. At least a component of the F_DIST may be along an axis of the vertical frame member 125. The support connection hub 100, as depicted, constrains the lateral frame member 120 and the vertical frame member 125 in cooperation with each other to transfer the F_DIST as an F_UNI along the vertical frame member 125 (e.g., to the ground). For example, the lateral frame member 120 and the vertical frame member 125 may cooperate, via the support connection hub 100, to support the tent 130.

Some embodiments may advantageously, for example, allow a greater width of a tent 130 supported by a trekking pole. By way of example and not limitation, the support connection hub 100 may advantageously enable a single compact structure that converts one or more trekking poles (e.g., multiple trekking poles, multiple lengths of a single trekking pole) and/or frame-segments from other equipment (e.g., a chair such as the chair 115) to be re-purposed as an extended width tent frame. For example, the support connection hub 100 may advantageously allow the lateral frame member 120 to be 'snapped in' to the transverse cavity 105 to hold the lateral frame member 120 registered orthogonally and in mechanical communication (e.g., direct contact, direct compressive load path) with the vertical frame member 125 (e.g., inserted into the longitudinal cavity 110).

In some embodiments, by way of example and not limitation, a lateral rod may be straight. In some implementations, a lateral rod may be curvilinear. For example, a lateral rod may be convex (e.g., before applying a load, after applying a load). In some implementations, for example, a lateral rod may be concave.

For example, in some implementations, a lateral rod may be pre-loaded (e.g., by compressive force applied at one or both ends of the rod). The pre-loading may, for example, induce a curvilinear shape.

In some implementations, for example, the lateral rod may be pre-formed into a neutral shape (e.g., during manufacturing).

Figure 5A:
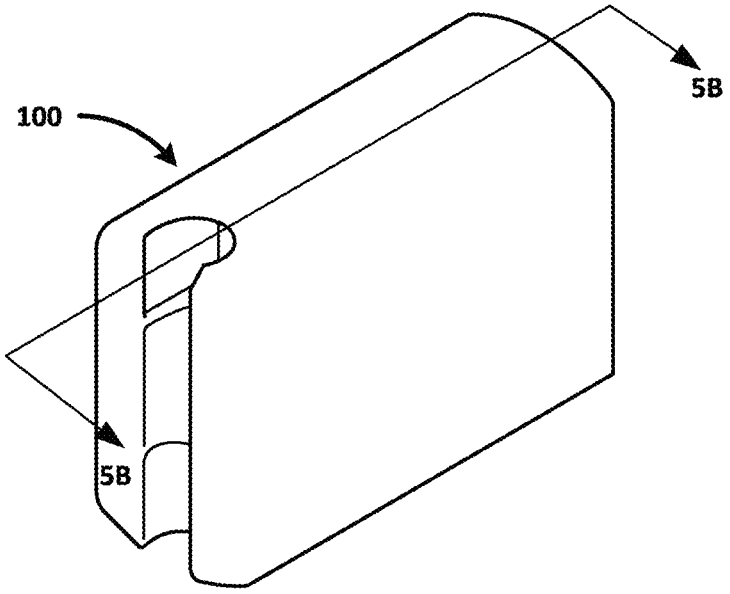
FIG. 5A and FIG. 5B depict a perspective view and a cross-section view, respectively, of the hub.
Figure 5B:
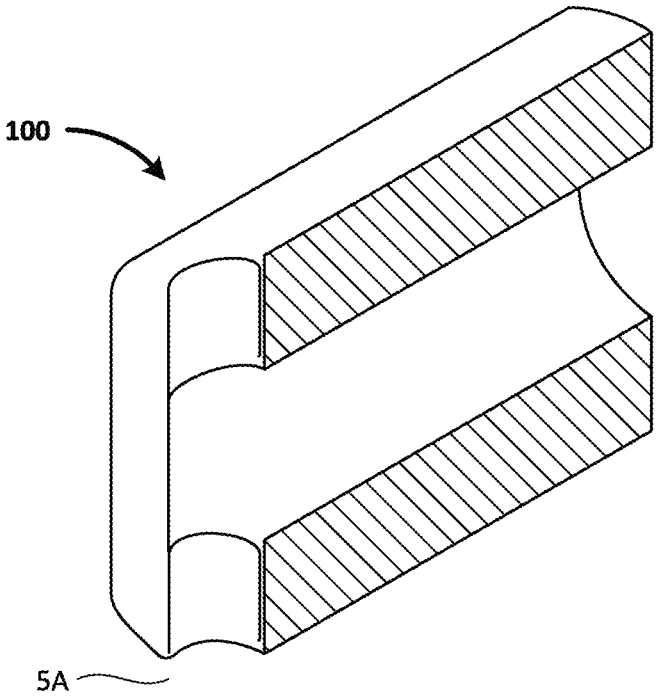
Figure 6A:
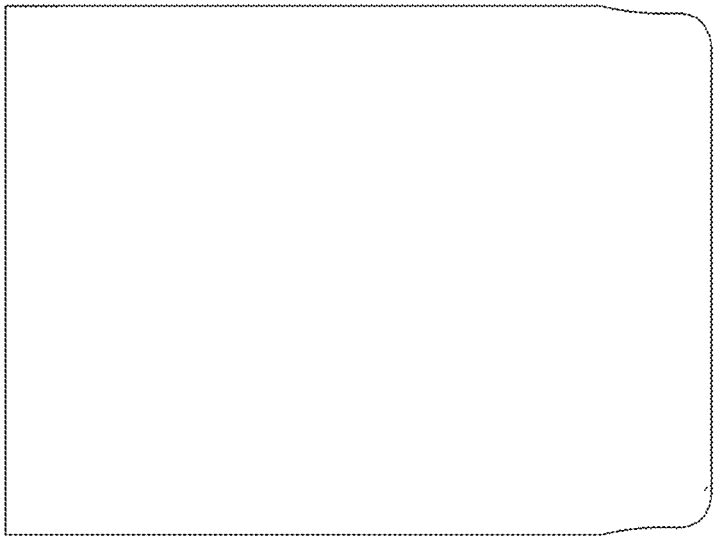
FIG. 6A, FIG. 6B, FIG. 6C, and FIG. 6D depict front, side, top, and bottom views, respectively, of the hub.
Figure 6B:
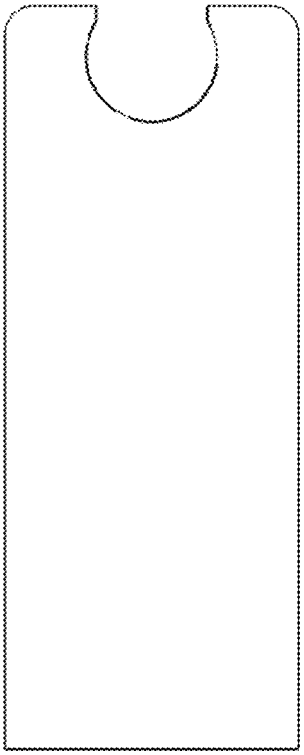
Figure 6C:
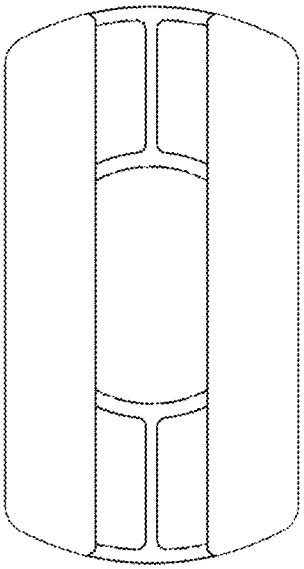
Figure 6D:
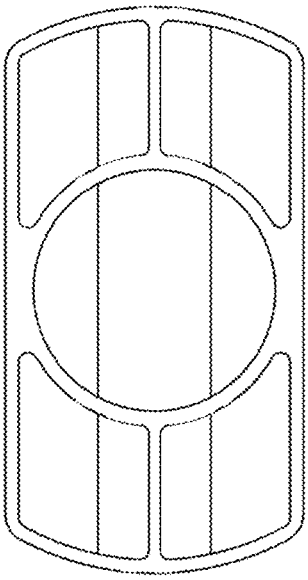

FIG. 5A and FIG. 5B depict a perspective view and a cross-section view, respectively, of the hub.

FIG. 6A, FIG. 6B, FIG. 6C, and FIG. 6D depict front, side, top, and bottom views, respectively, of the hub. In the depicted example, the front and back views are identical. In the depicted example, the left and right side views are identical.

Appendix A depicts exemplary embodiments of various systems and accessories which may be used, for example, in ultralight trekking. For example, at least pages 3-9 disclose an exemplary thermally insulative pad (TIP). As disclosed on page 4, the TIP may, by way of example and not limitation, be cut out of a single sheet of material from a thermal insert. The thermal insert may, for example, be configured such as disclosed at least with reference to FIGS. 4A-5C and 8A-8B of U.S. application Ser. No. 17/187,610, titled "Adaptive Chair with Multi-Functional Bag," filed by Robert Steven Graybill, on Feb. 26, 2021, and U.S. application Ser. No. 16/892,205, titled "MULTI-MODE PORTABLE COLLAPSIBLE CHAIR WITH MULTIPURPOSE ACCESSORY BAG," filed by Robert Steven Graybill, on Jun. 3, 2020, the entire contents of which are incorporated herein by reference.

The TIP may, for example, be an insulative and/or lightweight fabric (e.g., neoprene, foam, polyethylene terephthalate, polyterephthelate, natural fibers). In various embodiments the TIP may, for example, be multi-layer construction. In various embodiments the TIP may, for example, include reflective material (e.g., foil, aluminum). The TIP may, for example, provide a thermal barrier to inhibit conductive transfer (e.g., between a hand and a heat source and/or heat sink). Accordingly, the TIP may advantageously protect a user from burns and/or freezing.

In various embodiments the TIP may be provided with at least one retaining strap. The retaining strap may be configured, by way of example and not limitation, to releasably couple the TIP to a tool, body extremity (e.g., human, animal, hand, leg, arm), head, or some combination thereof. The TIP may be provided with at least one retaining loop which may, for example, be used to releasably couple a lanyard to. In various embodiments ointment, bandaging material, and/or a thermal pack (e.g., cold pack, heat pack) may be disposed on the TIP before application to a body portion and/or between the TIP and the body portion. In various embodiments the TIP and strap(s) may be used to apply compression (e.g., to a wound).

At least pages 10-26 disclose various embodiments of a field portable personal shelter system (FPPS). As depicted, in various embodiments a field portable collapsible chair may be used to support at least one end of the FPPS. In various embodiments one or more chair embodiments disclosed at least with reference to U.S. patent application Ser. No. 15/888,994; Ser. No. 16/368,391; Ser. No. 16/703,330; 62/454,112; 62/535,709; 62/620,305; Ser. No. 16/892,205; Ser. No. 17/187,610; and, 62/890,941; and, PCT Patent Application Serial No. PCT/US2018/016923, the entire contents of which applications are incorporated by reference, may be advantageously employed. The chair may, for example, releasably engage the tent forward of a bulkhead. The tent may be configured to receive a user's head toward the bulkhead. The bulkhead may have an access port. A forward vestibule may be provided to cover the chair when not in use. The vestibule may, for example, provide shelter for cargo. The vestibule may be retracted for a user to use the chair without decoupling it from the FPPS.

At least one side of the FPPS body may include an awning. The awning may, for example, be a flap releasably coupled to the FPPS. The awning may be staked open and/or supported in an open configuration by at least one support member. The support member may, for example, be a trekking pole segment. The awning may be provided, for example, with at least one pocket configured to receive at least one intended support member.

In various embodiments the awning may, for example, form a portion of the body of the FPPS. A mesh panel may be provided, for example, under the awning. The mesh panel may, for example, form an access door into the FPPS. In various embodiments (mesh) panels may be provided inside the body of the FPPS. The mesh panels may, for example, be disposed above and/or to the side of the user (e.g., suspended from ceiling and/or walls). The mesh panels may, for example, provide cargo storage area.

In various embodiments (e.g., as depicted at least with reference to page 19) at least one end of the FPPS may be supported by a lateral support member releasably coupled to an upright support member by a T-device. Accordingly, the chair may be advantageously freed for separate from the FPPS and/or the chair may be left behind (e.g., to reduce weight for backpacking).

In various embodiments at least some portion of a fore end (e.g., near a head of the user) wall of the FPPS may be constructed of an air-breathable (e.g., mesh) fabric. The mesh may, for example, be under a forward vestibule. At least one air-breathable (e.g., mesh) panel may be provided just aft of an apex to which the fore end wall is coupled. In various embodiments at least some portion of an aft end (e.g., near feet of the user) wall of the FPPS may be constructed of an air-breathable (e.g., mesh) fabric. The mesh may, for example, be under an aft vestibule. At least one mesh panel may be releasably covered by a solid panel such that the mesh is selectively openable. Accordingly, airflow may be selectively user controlled. Accordingly in various embodiments a user may advantageously experience a Bernoulli effect by opening at least two mesh panels allowing air to flow through the mesh panels. Air moving through the panels (e.g., above the user's head and/or body) may induce a low-pressure region, causing air to rise off the user towards the low-pressure region. Accordingly, ventilation may be advantageously user-controlled in such embodiments of the FPPS.

At least pages 27-30 depict exemplary T-devices. A T-device may releasably receive a lateral member in a first cavity and releasably receive a longitudinal member in a second cavity. The first and second cavities may communicate such that, when assembled, the longitudinal member and the lateral member may be in contact. The cavities may constrain a first axis of the lateral member to intersect a second axis of the longitudinal member. Accordingly, the T-device may, for example, advantageously constrain the longitudinal member to support the lateral member without requiring the T-device to directly support a compressive load downwards on the lateral member when the longitudinal member is substantially vertical. In various embodiments, the chair may be a trekking pole chair, exemplary embodiments of which are disclosed at least with reference to U.S. Patent Application Ser. No. 62/620,305; Ser. No. 16/892,205; Ser. No. 17/187,610; and, 62/890,941, the entire contents of which are incorporated herein by reference. As disclosed at least with reference to pages 29-30, a T-device may advantageously permit a trekking pole chair to be supported by a standard frame member and/or by a trek pole segment without a handle.

At least pages 31-36 depict exemplary embodiments of field portable shelter body (FPSB). As disclosed at least with reference to the FPPS, in various embodiments a portable chair may be used to support at least one end of a body of the FPSB. In various embodiments at least one end of the FPSB may be supported by at least one trek pole segment.

The FPSB may, for example, be configured for 1, 2, or more persons. The FPSB may be configured as a double-wall shelter. An upper portion of the FPSB may be provided with a breathable fabric (e.g., a mesh). In various embodiments an outer cover (e.g., a rain fly) may form at least one vestibule fore, aft, and/or to at least one side of the FPSB. The rain fly may, for example, be supported by the frame (e.g., chair, trek pole) of the FPSB. In various embodiments multiple trek pole segments may be joined, for example, by at least one coupler.

As depicted at least with reference to page 36, in various embodiments at least one end of the FPSB may be supported by at least one trek pole segment provided with a T-device releasably coupled to at least one lateral member. Accordingly, such embodiments may advantageously provide increased head room for a user. In various embodiments a single body may be advantageously reconfigured by a user by using a desired combination of supports (e.g., chair, trek pole, T-device, or some combination thereof).

As disclosed at least with reference to pages 37-40, various embodiments may be provided with a morphing shelter (MS). The MS may be configured to cover interchangeable shelter bodies (e.g., a 1-person, 2-person, or more FPSB). The MS may, for example, be provided with adjustable length tension members (e.g., straps, cables, paracord). An exemplary adjustable length tension member and associated mechanism is depicted with reference to FIG. 40. As depicted at least with reference to FIG. 38, adjustment of the tension members' length(s) may transition the MS and/or the associated body between at least two configurations. In various embodiments the configurations may, by way of example and not limitation, be different heights, geometries, or some combination thereof.

In various embodiments (e.g., as disclosed at least with reference to pages 41-44), a static tarp may be provided for various shelter bodies disclosed herein.

As disclosed at least with reference to pages 45-50, various embodiments of a trek pole coupler may be provided. The trek pole coupler may releasably couple trek pole segments together end to end along a single longitudinal axis. Accordingly, a length of a trek pole and/or trek pole segments may be quickly extended. Extension may advantageously maximize support by placing the segments end to end as compared to lashing them side by side with parallel longitudinal axes.

Appendix B depicts an exemplary sequence of operations for configuring a chair, such as disclosed at least with reference to FIG. 3.

Although various embodiments have been described with reference to the figures, other embodiments are possible. For example, a flexible surface may be a surface capable of manipulation (e.g., folding, rolling, re-shaping) under normal conditions by a human hand. For example, the flexible surface may include nylon fabric. The flexible surface may, for example, include composite-reinforced fabric able to manipulated by an average human under ambient temperatures.

Although an exemplary system has been described with reference to the figures, other implementations may be deployed in other industrial, scientific, medical, commercial, and/or residential applications. In various embodiments a shelter body and/or cover may be supported partially or solely by guidelines (e.g., to stakes, to trees, to rocks, to poles).

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated. Accordingly, other implementations are contemplated within the scope of the following claims.

What is claimed is:

1. A trekking system comprising:

a support connection hub comprising:

a first cavity extending longitudinally along a first axis and configured to receive a vertical support member at a bottom side of the support connection hub; and, a second cavity extending across a top of the support connection hub along a second axis substantially orthogonal to the first axis, the second cavity configured to horizontally and releasably receive a lateral support member substantially orthogonal to the vertical support member such that the lateral support member is configured to support a flexible surface distributed along the lateral support member and a load from the flexible surface is transferred to the vertical support member along a load path parallel to the first axis;

a collapsible tent comprising a first flexible surface configured such that, in a pitched mode, the lateral support member extends across a width of the tent, and the vertical support member extends along a height of the tent, and the lateral support member, the vertical support member, and the support connection hub are configured to support the first flexible surface as a shelter for a user;

a collapsible chair comprising a collapsible frame and a seat cover comprising a second flexible surface configured such that, in a seating mode, the lateral support member extends across a back of the chair as a lateral chair support, and the vertical support member is configured as a chair frame member.

2. The trekking system of claim 1, wherein the first cavity and the second cavity are configured such that the first axis intersects the second axis.

3. The trekking system of claim 1, further comprising an aperture into the second cavity, the aperture extending substantially parallel to the second axis along an entire length of the second cavity such that the lateral support member may be releasably coupled into the second cavity through the aperture.

4. The trekking system of claim 2, the tent comprising a plurality of tension members, wherein the flexible surface of the trekking tent comprises a vestibule configured such that, in the pitched mode, the plurality of tension members apply opposing forces at least partially transverse to the second axis, such that a force normal to the first axis applied by the guide wires is transferred as a distributed force to the lateral support member by the flexible surface, and the support connection hub constrains the lateral support member and the vertical support member such that the distributed force is transferred to the vertical support member along the load path.

5. The trekking system of claim 1, the seat cover comprising a pocket configured to receive the support connection hub, wherein, in the seating mode, the lateral support member is configured as a lateral chair support, and the vertical support member is configured as a chair frame member.

6. The trekking system of claim 1, wherein the vertical support member comprises at least one segment of a walking pole.

7. The trekking system of claim 6, wherein the walking pole comprises a multi-segment collapsible trekking pole.

8. The trekking system of claim 6, further comprising the walking pole.

* * * * *